US012287134B2

(12) United States Patent
Song et al.

(10) Patent No.: US 12,287,134 B2
(45) Date of Patent: Apr. 29, 2025

(54) METHOD OF OPERATING A BLDC MOTOR IN AN ICE MAKING APPLIANCE

(71) Applicant: Haier US Appliance Solutions, Inc., Wilmington, DE (US)

(72) Inventors: Yayu Song, Shanghai (CN); Bo Yan, Shanghai (CN); Michael Zhou, Shanghai (CN); Roy Teng, Shanghai (CN); Jin Wu, Shanghai (CN); Eddy Zhou, Shanghai (CN); Shi Zhijun, Shanghai (CN); Jason Jiang, Shanghai (CN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/917,292

(22) PCT Filed: Oct. 20, 2021

(86) PCT No.: PCT/CN2021/124867
§ 371 (c)(1),
(2) Date: Oct. 6, 2022

(87) PCT Pub. No.: WO2023/065133
PCT Pub. Date: Apr. 27, 2023

(65) Prior Publication Data
US 2025/0067488 A1 Feb. 27, 2025

(51) Int. Cl.
*F25C 1/147* (2018.01)

(52) U.S. Cl.
CPC ..... *F25C 1/147* (2013.01); *F25C 2600/04* (2013.01)

(58) Field of Classification Search
CPC ..... F25C 1/147; F25C 2600/04
See application file for complete search history.

(56) References Cited

U.S. PATENT DOCUMENTS

| | | | | |
|---|---|---|---|---|
| 7,053,583 | B1 | 5/2006 | Hazelton | |
| 10,126,037 | B2 | 11/2018 | Barrena et al. | |
| 2018/0245832 | A1 | 8/2018 | Ji et al. | |
| 2019/0226741 | A1 * | 7/2019 | Mitchell | F25C 1/147 |

(Continued)

FOREIGN PATENT DOCUMENTS

| | | | | |
|---|---|---|---|---|
| DE | 102016216673 | A1 * | 3/2018 | H02P 7/265 |
| JP | 3850299 | B2 * | 11/2006 | F25C 1/147 |

(Continued)

*Primary Examiner* — Emmanuel E Duke
(74) *Attorney, Agent, or Firm* — Dority & Manning, P.A.

(57) ABSTRACT

An icemaker includes a casing that receives water from a water supply and is in thermal communication with an evaporator of a sealed system that chills the casing to freeze the water. An auger is mounted within the interior volume and is rotatable to scrape the ice from the casing and urge it through an extruder to form nugget ice. A BLDC motor is mechanically coupled to the auger to selectively rotate the auger. A controller determines a target speed of the auger based at least in part on the ice production parameter, and operates the BLDC motor to rotate the auger at the target speed. The BLDC motor with the speed-closed control loop can provide the constant speed and enough torque to prevent the ice maker from freezing. The controller can adjust the PWM and the voltage will be adjusted slightly, then the torque will be adjusted accordingly.

18 Claims, 6 Drawing Sheets

(56) References Cited

U.S. PATENT DOCUMENTS

| | | | | |
|---|---|---|---|---|
| 2020/0370811 | A1 | 11/2020 | Byun et al. | |
| 2021/0131714 | A1* | 5/2021 | Miller | F25C 5/22 |
| 2022/0347811 | A1* | 11/2022 | Abbott | B23Q 15/12 |

FOREIGN PATENT DOCUMENTS

| | | | | |
|---|---|---|---|---|
| JP | 2007218446 | A | * | 8/2007 |
| JP | 2013533908 | A | | 8/2013 |
| JP | 2020008235 | A | | 1/2020 |
| KR | 2012058040 | A | | 6/2012 |
| KR | 2018101133 | A | | 9/2018 |

* cited by examiner

METHOD OF OPERATING A BLDC MOTOR IN AN ICE MAKING APPLIANCE

CROSS-REFERENCE TO RELATED APPLICATIONS

The present application is the National Stage Entry of and claims the benefit of priority under 35 U.S.C. § 371 to PCT Application Serial No. PCT/CN2021/124867 filed Oct. 20, 2021 and entitled METHOD OF OPERATING A BLDC MOTOR IN AN ICE MAKING APPLIANCE, which is hereby incorporated by reference in its entirety for all purposes.

FIELD OF THE INVENTION

The present subject matter relates generally to ice making appliances, and more particularly to methods of operating an ice making appliance in a refrigerator appliance and a countertop ice maker appliance.

BACKGROUND OF THE INVENTION

Refrigerator appliances generally include a cabinet that defines a chilled chamber for receipt of food articles for storage. In addition, refrigerator appliances include one or more doors rotatably hinged to the cabinet to permit selective access to food items stored in chilled chamber(s). The refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

Conventional refrigerator appliances further include dispensing assemblies for supplying a user with ice and/or water. For example, such dispensing assemblies may include an icemaker for producing ice for use by consumers, such as for cooling foods or drinks to be consumed, for chilling other items, or for various other purposes. Conventional icemakers are mounted to a door of the appliance for providing ice through a discharge opening defined in the front of the door. A new trend in ice production relates to the use of slush or nugget ice that has a different consistency than conventional frozen ice cubes. However, conventional nugget icemakers operate at a single speed, providing little versatility in terms of ice production, quality, hardness, etc. In addition, conventional motors for nugget icemakers may not be very effective in breaking up tough ice clogs.

Accordingly, a refrigerator appliance with an improved ice making assembly would be desirable. More specifically, an ice making appliance that provides improved versatility in the type, quality, or consistency of ice produced would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, an icemaker is provided including a casing defining an interior volume, a water supply for selectively providing water into the interior volume, a sealed system comprising an evaporator in thermal communication with the casing for selectively freezing the water, an auger mounted within the interior volume, the auger being rotatable to scrape the ice from the casing, a BLDC motor mechanically coupled to the auger to selectively rotate the auger, and a controller in operative communication with the BLDC motor. The controller is configured to obtain an ice production parameter from a user of the icemaker, determine a target speed of the auger based at least in part on the ice production parameter, and operate the BLDC motor to rotate the auger at the target speed and generate ice in accordance with the ice production parameter.

In another exemplary embodiment, a method of operating an icemaker is provided. The icemaker includes an auger rotatably mounted within a casing to scrape ice from the casing and a BLDC motor mechanically coupled to the auger to selectively rotate the auger. The method includes obtaining an ice production parameter from a user of the icemaker, determining a target speed of the auger based at least in part on the ice production parameter, and operating the BLDC motor to rotate the auger at the target speed and generate ice in accordance with the ice production parameter.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
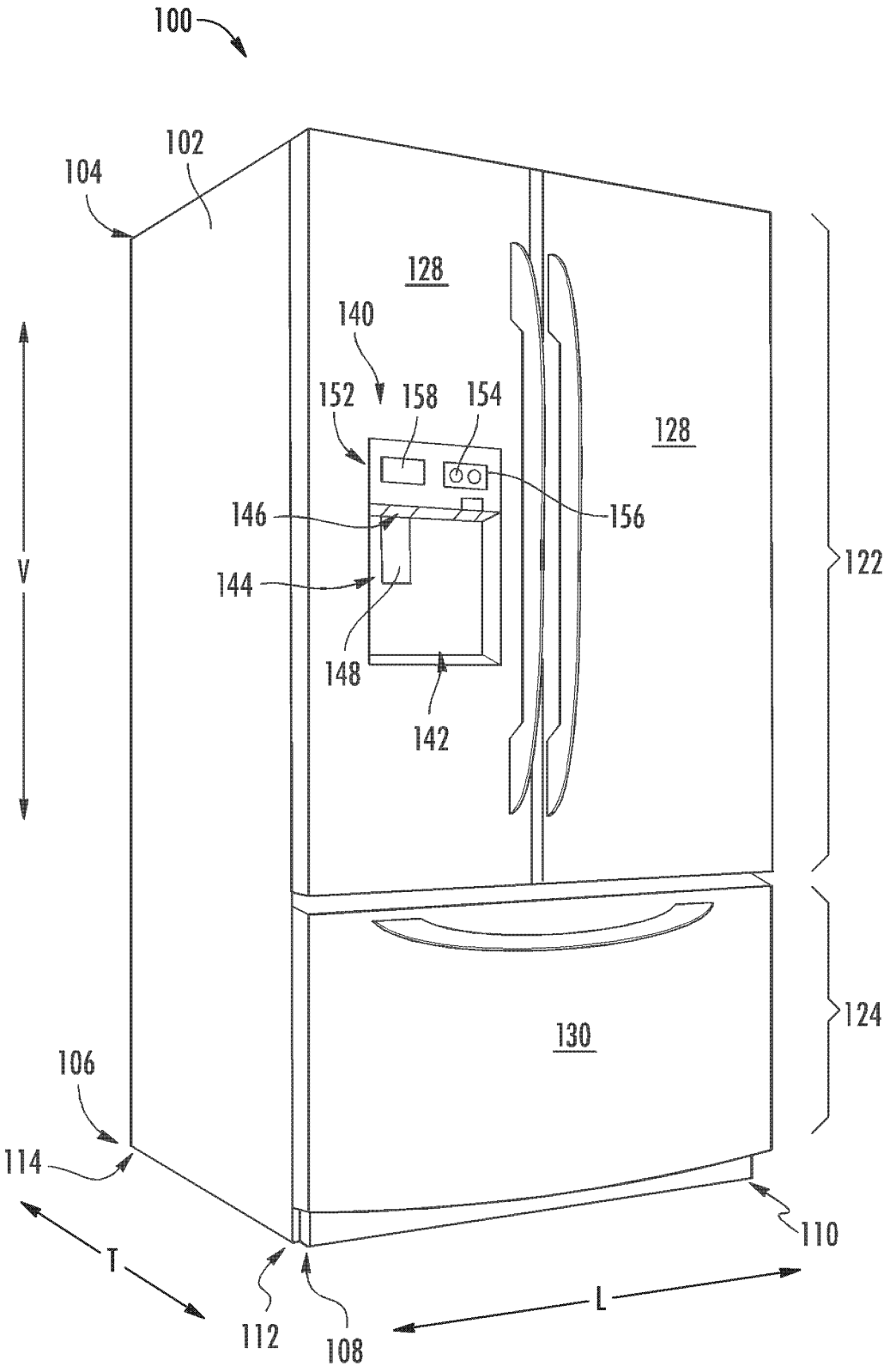
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
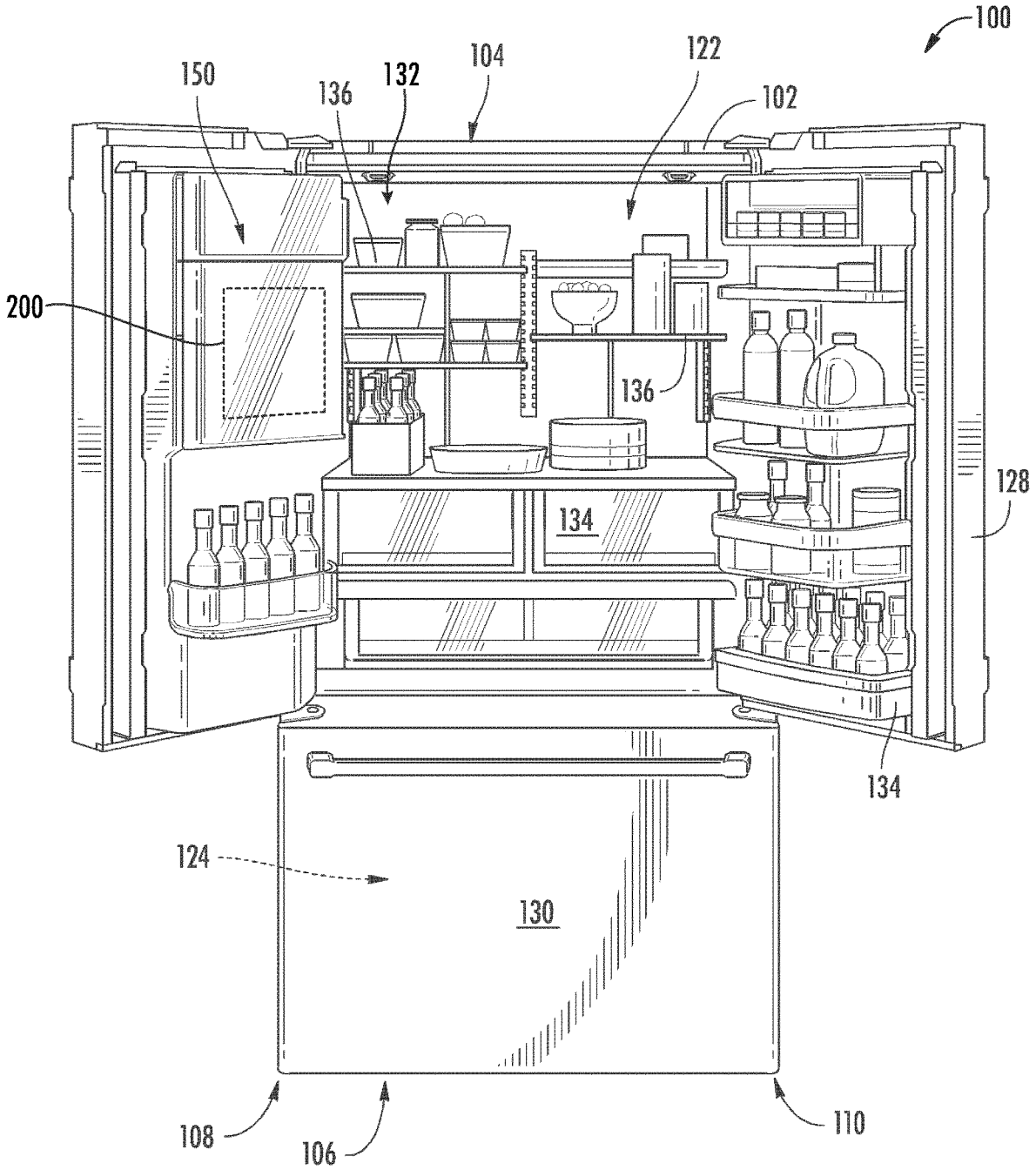
FIG. 2 provides a perspective view of the exemplary refrigerator appliance of FIG. 1, with the doors of the fresh food chamber shown in an open position and including a door-mounted icemaker according to an exemplary embodiment of the present subject matter.

Referring now to the figures, an exemplary appliance will be described in accordance with exemplary aspects of the present subject matter. Specifically, FIG. 1 provides a perspective view of an exemplary refrigerator appliance 100 and FIG. 2 illustrates refrigerator appliance 100 with some of the doors in the open position. As illustrated, refrigerator appliance 100 generally defines a vertical direction V, a lateral direction L, and a transverse direction T, each of which is mutually perpendicular, such that an orthogonal coordinate system is generally defined.

According to exemplary embodiments, refrigerator appliance 100 includes a cabinet 102 that is generally configured for containing and/or supporting various components of refrigerator appliance 100 and which may also define one or more internal chambers or compartments of refrigerator appliance 100. In this regard, as used herein, the terms "cabinet," "housing," and the like are generally intended to refer to an outer frame or support structure for refrigerator appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of refrigerator appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top 104 and a bottom 106 along the vertical direction V, between a first side 108 (e.g., the left side when viewed from the front as in FIG. 1) and a second side 110 (e.g., the right side when viewed from the front as in FIG. 1) along the lateral direction L, and between a front 112 and a rear 114 along the transverse direction T. In general, terms such as "left," "right," "front," "rear," "top," or "bottom" are used with reference to the perspective of a user accessing appliance 102.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Moreover, aspects of the present subject matter may be applied to other appliances as well. Consequently, the description set forth herein is for illustrative purposes only and is not intended to be limiting in any aspect to any particular appliance or configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. In general, refrigerator doors 128 form a seal over a front opening 132 defined by cabinet 102 (e.g., extending within a plane defined by the vertical direction V and the lateral direction L). In this regard, a user may place items within fresh food chamber 122 through front opening 132 when refrigerator doors 128 are open and may then close refrigerator doors 128 to facilitate climate control. Refrigerator doors 128 and freezer door 130 are shown in the closed configuration in FIG. 1. One skilled in the art will appreciate that other chamber and door configurations are possible and within the scope of the present invention.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring again to FIG. 1, a dispensing assembly 140 will be described according to exemplary embodiments of the present subject matter. Although several different exemplary embodiments of dispensing assembly 140 will be illustrated and described, similar reference numerals may be used to refer to similar components and features. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating water or ice dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142. By contrast, refrigerator door 128 may define an icebox compartment 150 (FIG. 2) housing an icemaker (e.g., such as icemaker 200 described below) and an ice storage bin that are configured to supply ice to dispenser recess 142.

A control panel 152 is provided for controlling the mode of operation. For example, control panel 152 includes one or more selector inputs 154, such as knobs, buttons, touch-screen interfaces, etc., such as a water dispensing button and an ice-dispensing button, for selecting a desired mode of operation such as crushed or non-crushed ice, ice type, consistency, etc. In addition, inputs 154 may be used to specify a fill volume or method of operating dispensing assembly 140. In this regard, inputs 154 may be in communication with a processing device or controller 156. Signals generated in controller 156 operate refrigerator appliance 100 and dispensing assembly 140 in response to selector inputs 154. Additionally, a display 158, such as an indicator light or a screen, may be provided on control panel 152. Display 158 may be in communication with controller 156 and may display information in response to signals from controller 156.

As used herein, "processing device" or "controller" may refer to one or more microprocessors or semiconductor devices and is not restricted necessarily to a single element. The processing device can be programmed to operate refrigerator appliance 100, dispensing assembly 140 and other components of refrigerator appliance 100. The processing device may include, or be associated with, one or more memory elements (e.g., non-transitory storage media). In some such embodiments, the memory elements include electrically erasable, programmable read only memory (EEPROM). Generally, the memory elements can store information accessible by a processing device, including instructions that can be executed by processing device. Optionally, the instructions can be software or any set of instructions and/or data that when executed by the processing device, cause the processing device to perform operations.

As shown schematically in FIG. 2 and mentioned briefly above, refrigerator appliance 100 may include an ice making assembly or icemaker 200 that is positioned within icebox compartment 150 for generating ice for user consumption. In this regard, for example, icemaker 200 may be mounted to one of refrigerator doors 130 and may produce ice that is dispensed through dispensing assembly 140 (e.g., view discharging outlet 146). More specifically, according to exemplary aspects of the present subject matter, icemaker 200 is a nugget icemaker, as explained in more detail below.

Figure 3:
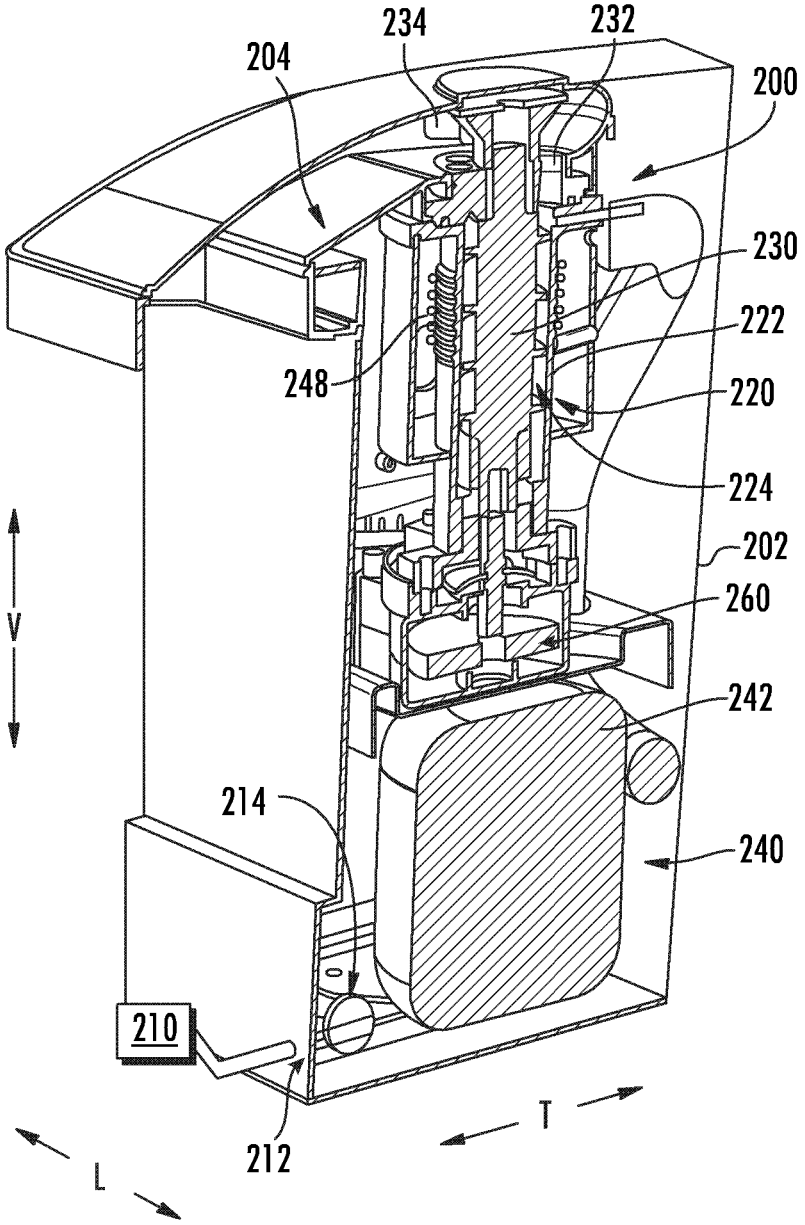
FIG. 3 provides a cross-sectional view of the exemplary icemaker of FIG. 2 according to exemplary embodiments of the present disclosure.
Figure 4:
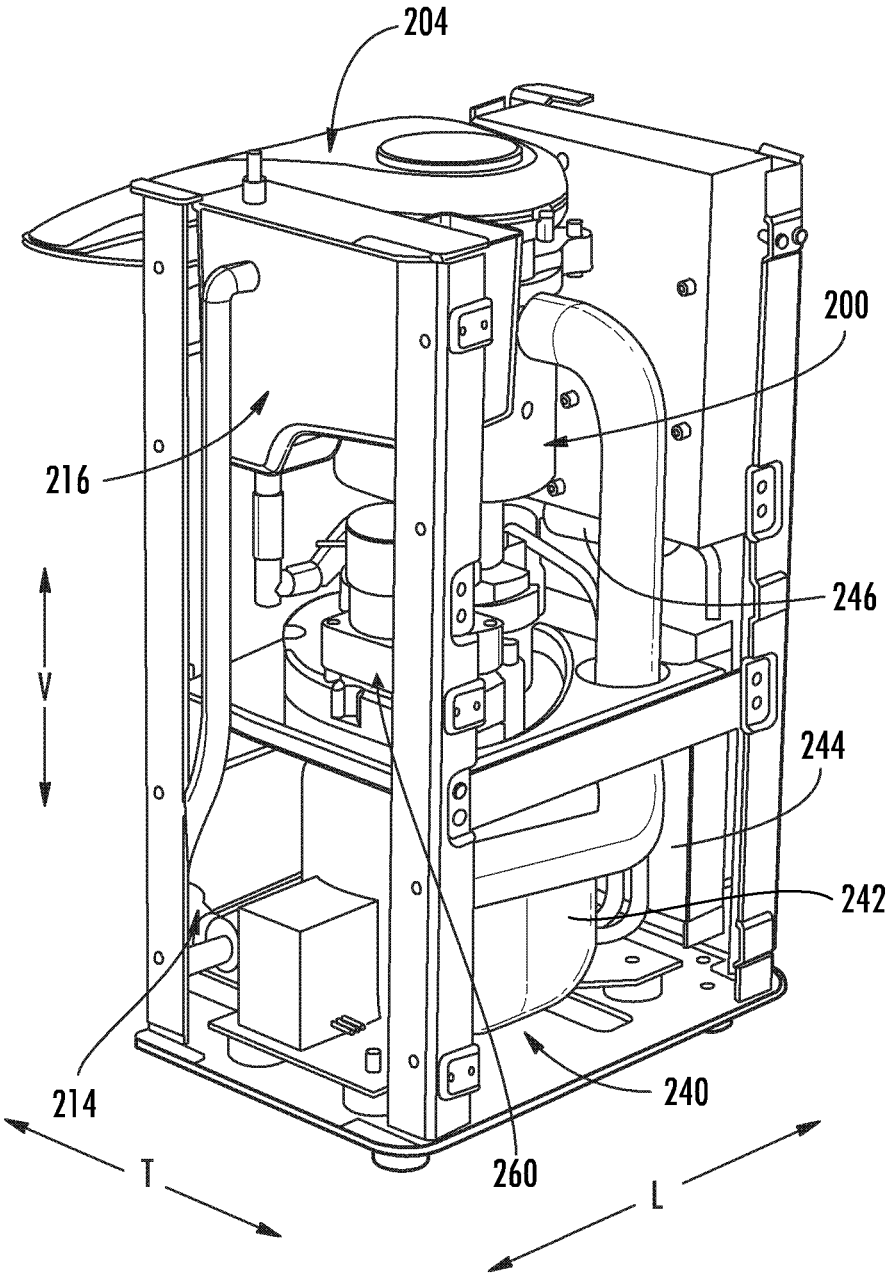
FIG. 4 provides a rear perspective view of the exemplary icemaker of FIG. 2 with an outer casing removed.

Referring again to the figures, icemaker 200 will be described in accordance with exemplary aspects of the present subject matter. Specifically, FIG. 3 provides a perspective, cross-sectional view of icemaker 200 and FIG. 4 provides a rear perspective view of icemaker 200. As mentioned above, icemaker 200 may be sized, designed, and configured for being positioned within icebox compartment 150 of refrigerator appliance 100. However, it should be appreciated that aspects of the present subject matter may be used in any other suitable ice making appliance, such as a countertop nugget icemaker.

As illustrated, icemaker 200 includes a casing 202 that is generally configured for containing and/or supporting various components of icemaker 200 and which may also define one or more internal chambers or compartments of icemaker 200. In this regard, as used herein, the terms "casing," "cabinet," "housing," and the like are generally intended to refer to an outer frame or support structure for icemaker 200, e.g., including any suitable number, type, and configuration of support structures formed from any suitable materials, such as a system of elongated support members, a plurality of interconnected panels, or some combination thereof. It should be appreciated that casing 202 does not necessarily require an enclosure and may simply include open structure supporting various elements of icemaker 200. By contrast, casing 202 may enclose some or all portions of an interior of casing 202. It should be appreciated that casing 202 may have any suitable size, shape, and configuration while remaining within the scope of the present subject matter.

As illustrated, icemaker 200 generally defines a vertical direction V, a lateral direction L, and a transverse direction T, each of which is mutually perpendicular, such that an orthogonal coordinate system is generally defined. Specifically, for example, these directional orientations may correspond to the same directional orientations as described above with respect to refrigerator appliance 100. Accordingly, these directions may be used interchangeably to refer to icemaker 200 (e.g., when installed in refrigerator door 128 and when refrigerator door 128 is in the closed position).

As noted above, icemaker 200 is generally sized and shaped to be mounted within icebox compartment 150. Nonetheless, it is understood that icemaker 200 is provided as an exemplary embodiment and the present disclosure not limited to any particular size or shape, except as otherwise provided herein. For example, aspects of the present subject matter may also be applied in a conventional residential or commercial countertop icemaker.

Turning now generally to FIGS. 3 and 4, icemaker 200, will be described in more detail according to exemplary embodiments of the present subject matter. In general, icemaker 200 is generally configured for producing ice and an ice dispensing chute 204 that is generally configured for directing ice through discharging outlet 146 of refrigerator appliance 100 for consumption by a user of icemaker 200. Each of these components and assemblies will be described in more detail below according to an exemplary embodiment of the present subject matter. However, it should be appreciated that other means for forming, storing, and dispensing ice may be used while remaining within the scope of the present subject matter.

As best shown in FIG. 3, icemaker 200 generally includes a water supply 210 that is generally configured for providing a flow of water to facilitate ice formation. For example, water supply 210 may be a municipal water supply connected to refrigerator appliance 100, an internal water storage or cooling tank within refrigerator appliance 100, or any other suitable source of potable water. According to exemplary embodiments, water supply 210 may be fluidly coupled to icemaker 200 through a water supply opening 212 such that water from water supply 210 may be supplied to icemaker 200 to form ice.

Generally, icemaker 200 is positioned downstream of water supply 210 and water supply opening 212. Thus, when assembled, icemaker 200 may receive a steady supply water to facilitate ice formation. To continually supply water to icemaker 200, icemaker 200 may further include a pump 214 that may be in fluid communication with water supply 210. For example, water may be flowable from the water supply 210 through water supply opening 212 and through a conduit to and through pump 214. Pump 214 may, when activated, actively flow water from the water supply 210 therethrough and from the pump 214.

Water actively flowed from the pump 214 may be flowed (e.g., through a suitable conduit) to a reservoir 216 (FIG. 4). For example, reservoir 216 may define a storage volume, which may, for example, be in fluid communication with the pump 214 and may thus receive water that is actively flowed from the water supply 210, such as through the pump 214. For example, water may be flowed into reservoir 216 through an opening defined in the reservoir 216. Reservoir 216 and the storage volume thereof may receive and contain water to be provided to icemaker 200 for the production of ice. Accordingly, reservoir 216 may be in fluid communication with icemaker 200. For example, water may be flowed, such as through an opening and through suitable conduits, from the storage volume to icemaker 200.

Icemaker 200 generally receives water, such as from reservoir 216, and freezes the water to form ice. In exemplary embodiments, icemaker 200 is a nugget ice maker, and in particular is an auger-style ice maker, although other suitable styles of ice makers are within the scope and spirit of the present disclosure. As shown, icemaker 200 may include a casing 220 into which water from reservoir 216 is flowed. Casing 220 is thus in fluid communication with reservoir 216. For example, casing 220 may include one or more sidewalls 222 which may define an interior volume 224, and an opening may be defined in a sidewall 222. Water may be flowed from reservoir 216 through the opening (such as via a suitable conduit) into the interior volume 224.

As illustrated, an auger 230 may be disposed at least partially within the casing 220. During operation, the auger 230 may rotate. Water within the casing 220 may at least partially freeze due to heat exchange, such as with a refrigeration system as discussed herein. The at least partially frozen water may be lifted by the auger 230 from casing 220. Further, in exemplary embodiments, the at least partially frozen water may be directed by auger 230 to and through an extruder 232. The extruder 232 may extrude the at least partially frozen water to form ice, such as nuggets of ice.

In some embodiments, for example, a sweep 234, which may for example be connected to and rotate with the auger 230, may contact the ice emerging through the extruder 232 from the auger 230 and direct the ice out of icemaker 200 through ice dispensing chute 204. Specifically, according to exemplary embodiments, ice dispensing chute 204 is generally positioned adjacent sweep 234 for receiving ice discharged from icemaker 200. Thus, ice can slide off ice dispensing chute 204 and drop through discharging outlet 146 of dispensing assembly 140. According to exemplary embodiments, ice dispensing chute 204 may extend between icemaker 200 and discharging outlet 146 and may include any suitable ice regulating devices for regulating ice discharge. For example, ice dispensing chute 204 may include a pivoting flap or closing mechanism for selectively closing ice dispensing chute 204 and/or discharging outlet 146.

As discussed, water within the casing 220 may at least partially freeze due to heat exchange, such as with a refrigeration system. In exemplary embodiments, icemaker 200 may include a sealed refrigeration system 240. The sealed refrigeration system 240 may be in thermal communication with the casing 220 to remove heat from the casing 220 and interior volume 224 thereof, thus facilitating freezing of water therein to form ice. Sealed refrigeration system 240 may, for example, include a compressor 242, a condenser 244, a throttling device 246, and an evaporator 248. Evaporator 248 may, for example, be in thermal communication with the casing 220 in order to remove heat from the interior volume 224 and water therein during operation of sealed system 240. For example, evaporator 248 may at least partially surround the casing 220. In particular, evaporator 248 may be a conduit coiled around and in contact with casing 220, such as the sidewall(s) 222 thereof.

During operation of sealed system 240, refrigerant exits evaporator 248 as a fluid in the form of a superheated vapor or vapor mixture. Upon exiting evaporator 248, the refrigerant enters compressor 242 wherein the pressure and temperature of the refrigerant are increased such that the refrigerant becomes a superheated vapor. The superheated vapor from compressor 242 enters condenser 244 wherein energy is transferred therefrom and condenses into a saturated liquid or liquid vapor mixture. This fluid exits condenser 244 and travels through throttling device 246 that is configured for regulating a flow rate of refrigerant therethrough. Upon exiting throttling device 246, the pressure and temperature of the refrigerant drop at which time the refrigerant enters evaporator 248 and the cycle repeats itself. In certain exemplary embodiments, throttling device 246 may be a capillary tube. Notably, in some embodiments, sealed system 240 may additionally include fans (not shown) for facilitating heat transfer to/from the condenser 244 and evaporator 248.

Referring still to FIGS. 3 and 4, icemaker may further include a motor assembly 260 that is mechanically coupled to auger 230 for selectively rotating auger 230. Specifically, according to the illustrated embodiment, motor assembly 260 is mounted directly below auger 230 within casing 202. In general, motor assembly 260 is in operative communication within controller 156 which may be configured to selectively rotate auger 230 to generate ice as desired or selected by a user of refrigerator appliance 100.

As used herein, "motor" may refer to any suitable drive motor and/or transmission assembly for rotating the auger 230. For example, motor assembly 260 may include a brushless direct current ("BLDC") electric motor, a stepper motor, or any other suitable type or configuration of motor. For example, motor assembly 260 may include an alternating current ("AC") motor, an induction motor, a permanent magnet synchronous motor, or any other suitable type of AC motor. In addition, motor assembly 260 may include any suitable transmission assemblies, clutch mechanisms, or other components. According to an exemplary embodiment, motor assembly 260 may be operably coupled to a controller (e.g., such as controller 156), which is programmed to rotate auger 230 as described herein.

Figure 6:
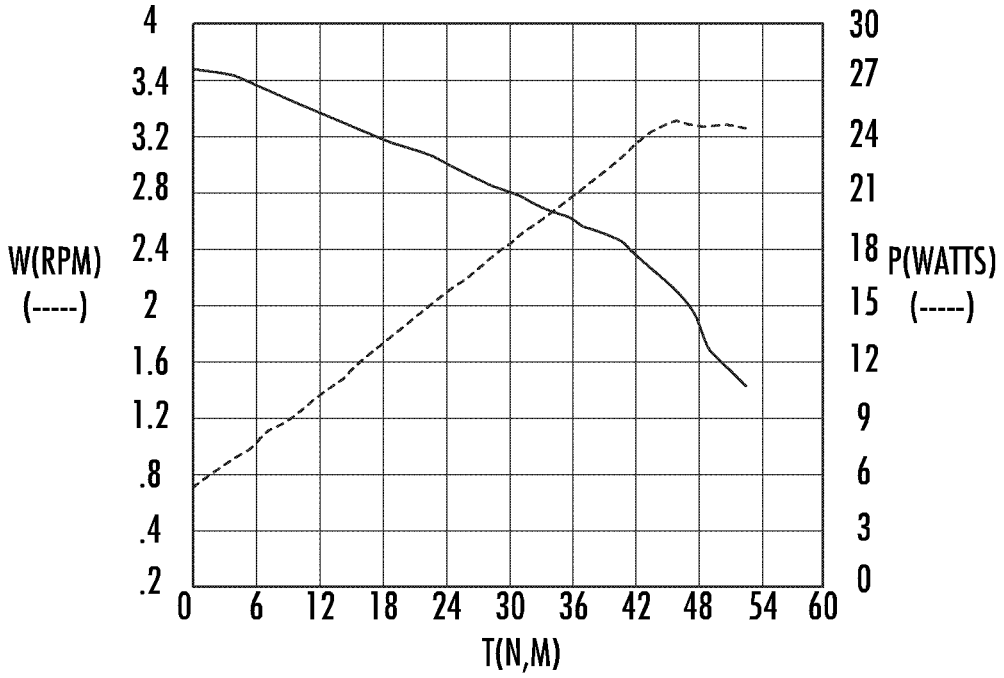
FIG. 6 provides a plot of the motor speed and power over applied torque for a BLDC motor according to an exemplary embodiment.

Notably, conventional icemakers use single-phase AC induction geared motors, such as a fixed speed shaded-pole motor. For example, these single speed motors are selected to rotate at a single speed and in a single direction to form ice by rotating auger. However, single speed rotation provides little versatility into the ice making process and often generates insufficient torque to break stubborn ice clogs or freezes. For example, by adjusting the rotational speed or torque of auger 230, ice may be formed at different rates, amounts, qualities, densities, hardnesses, etc. Accordingly, aspects of the present subject matter are generally directed to the use of a BLDC motor in a nugget icemaker and associated methods of operation that are useful to prevent icemaker 200 from freezing up and for providing versatility into the ice production process. In this regard, as best shown in FIG. 6, a BLDC motor may have a particularly desirable power-torque-speed profile that permits improved versatility in ice production and effective elimination of frozen clogs.

Now that the construction of icemaker 200 according to exemplary embodiments has been presented, an exemplary method 300 of operating an icemaker 200 will be described. Although the discussion below refers to the exemplary method 300 of operating icemaker 200, one skilled in the art will appreciate that the exemplary method 300 is applicable to the operation of a variety of other ice making appliances. In exemplary embodiments, the various method steps as disclosed herein may be performed by a controller 156 of refrigerator appliance 100 or a separate, dedicated controller.

Figure 5:
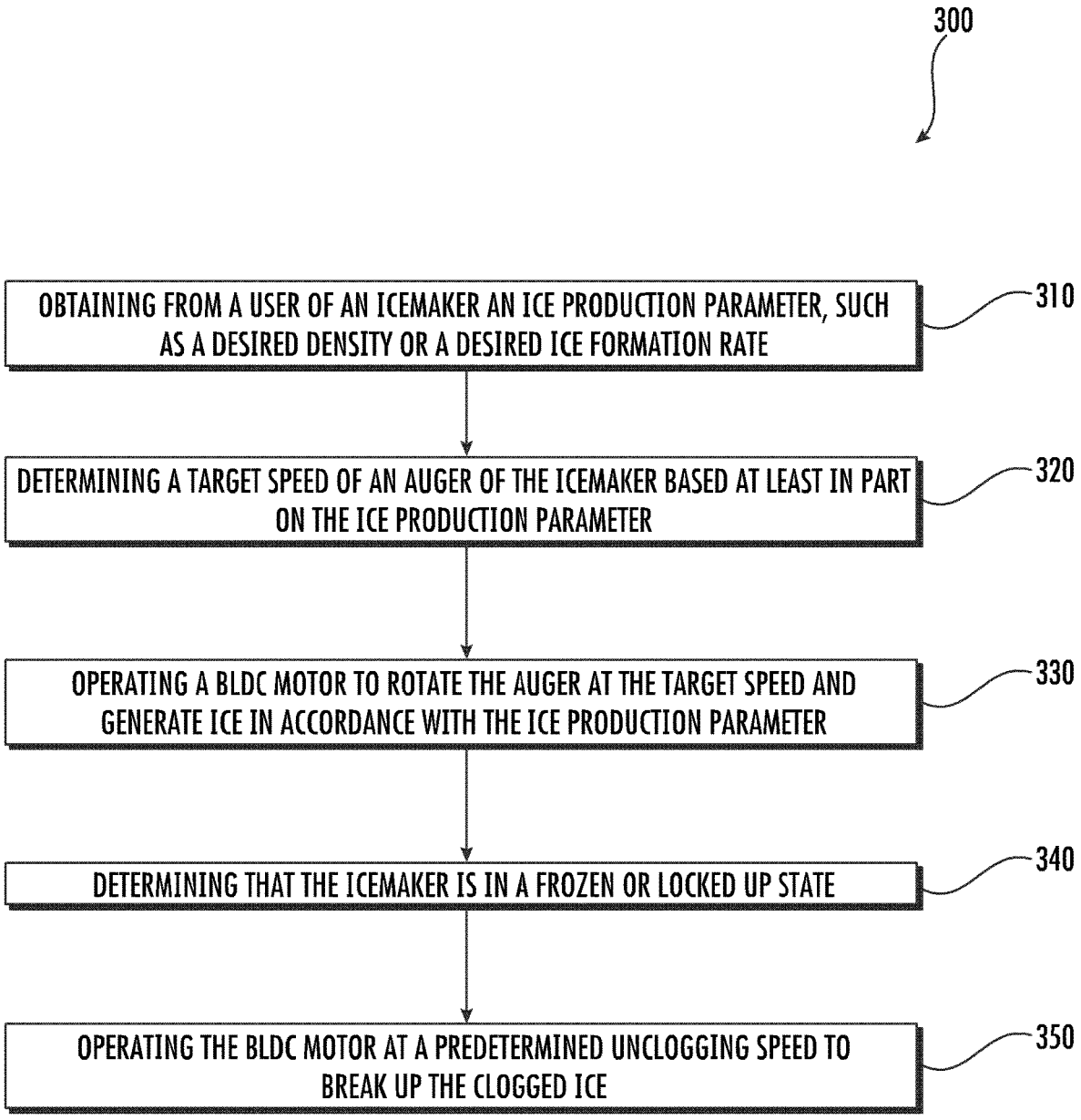
FIG. 5 provides a method for operating an icemaker according to an exemplary embodiment of the present subject matter.

Referring now to FIG. 5, method 300 includes, at step 310, obtaining an ice production parameter from a user of an icemaker. For example, continuing the example from above, a user may input the ice production parameter using a control panel 152 of refrigerator appliance 100. For example, a user may select the type, quality, density, or other suitable parameters related to the ice desired prior to pressing the actuating mechanism 148. Controller 156 may be in operative communication with icemaker 200 and may operate BLDC motor 260 as needed to generate and dispense ice in accordance with the selected ice production parameter.

As used herein, the terms "ice production parameter" and the like are generally intended to refer to any qualitative or quantitative characteristics of ice that is formed by icemaker 200. For example, the ice production parameter may be associated with any suitable operating parameter adjustment of icemaker 200 that generates ice that is different in any suitable manner. For example, the ice production parameter may be a desired ice density or the desired ice formation rate. Although these ice production parameters will be described below to facilitate discussion of aspects of the present subject matter, it should be appreciated that these ice production parameters are only exemplary and not intended to limit the scope of the present subject matter in any manner.

As explained briefly above, icemaker 200 operates by rotating auger 230 to scrape ice that is formed on sidewalls 222 of casing 220. The ice that flakes off or is scraped from sidewalls 222 is urged upward to the extruder 232 where it is compressed through the extruder and discharged through ice dispensing chute 204. Notably, the characteristics of the ice generated and dispensed may vary based on many factors. For example, the speed of auger 230 may be adjusted to control the ice formation rate and/or density of formed ice.

In this regard, for example, increasing the auger rotation speed may tend to generate flaky your or fluffier ice (e.g., ideal for slushies or drinks), while decreasing the auger rotation speed may tend to generate harder, denser ice (e.g., ideal for coolers). Accordingly, aspects of the present subject matter are directed to adjusting the operation of BLDC motor 260 to generate the desired ice (e.g., ice in accordance with the ice production parameters).

Specifically, step 320 may include determining a target speed of an auger of the icemaker based at least in part on the ice production parameter. In this regard, controller 156 refrigerator appliance 100 may receive the user input regarding the ice production parameter (e.g., the desired ice density) and may adjust the operation of auger 230 to produce and dispense ice in accordance with that ice production parameter. For example, if a user wishes to have flaky ice, the target speed may be relatively high, whereas the target speed may be relatively low for hard or dense ice. By contrast, if the ice production parameter requests a very large ice formation rate, the rotational speed of auger 230 may be adjusted for maximum ice production.

As explained above, ice production parameter may generally relate to a hardness or density level of the ice generated by icemaker 200. Accordingly, determining the target speed may include using a predetermined moderate speed or a "hard ice speed" to form hard ice or ice with a relatively high density. In this regard, for example, the predetermined moderate speed may be specified relative to a rated speed of the BLDC motor 260, e.g., from 0% to 100% of the full rated power and/or speed of the motor. In this regard, a predetermined moderate speed may be between about 10% and 90% of the rated speed, between about 20% and 80% of the rated speed, between about 25% and 75% of the rated speed, between about 40% and 60% of the rated speed, or about 50% of the rated speed of BLDC motor 260. According to exemplary embodiments, the target speed for hard ice may be between about 2.5 and 4.5 revolutions per minute, between about 3 and 4 revolutions per minute, or about 3.5 revolutions per minute.

By contrast, if the ice production parameter is the production of low-density or flake ice, determining the target speed may include using a predetermined fast speed or a "flake ice speed" to form flake ice or ice with a relatively low density. In this regard, for example, the predetermined fast speed may be specified relative to a rated speed of the BLDC motor 260, e.g., from 0% to 100% of the full rated power and/or speed of the motor. In this regard, a predetermined fast speed may be between about 25% and 100% of the rated speed, between about 40% and 90% of the rated speed, between about 50% and 80% of the rated speed, between about 60% and 70% of the rated speed, or about 65% of the rated speed of BLDC motor 260. According to exemplary embodiments, the target speed for flake ice may be between about 3 and 6 revolutions per minute, between about 4 and 5 revolutions per minute, or about 4.6 revolutions per minute.

According to exemplary embodiments, ice production parameter may relate to an ice formation rate of ice formed by icemaker 200. In this regard, controller 156 may generally be configured to adjust rotation of auger 230 to adjust ice formation rate of the water within the interior volume 224. For example, the rotational speed of auger 230 may be increased to prevent freezing over of interior volume 224 due to the increased cooling capacity of icemaker 200.

Step 330 generally includes operating the BLDC motor to rotate auger at the target speed and generate ice in accordance with the ice production parameter (e.g., as specified at step 310). In this manner, the ice dispensed from icemaker 200 may have any suitable characteristics specified by a user via control panel 152. In other words, a user may select a small volume of dense or hard ice, a large volume of flaky ice, or some combination therebetween. The use of BLDC motor 260 and the methods described herein thus provide improved versatility and user satisfaction with icemaker 200 and refrigerator appliance 100.

Notably, by monitoring a motor feedback signal of BLDC motor 260, method 300 may further include a freeze or clog detection process. In this regard, step 340 may include determining that the icemaker is in a frozen or locked up state. In this manner, as shown in FIG. 6, as the rotational speed of BLDC motor 260 increases, the torque applied by BLDC motor decreases. By contrast, as the rotational speed of BLDC motor 260 decreases, the torque applied by BLDC motor increases. Controller 156 may be programmed with such operating characteristics and may use deviations from such operating characteristics to identify a frozen or locked icemaker 200.

Step 350 may include operating the BLDC motor at a predetermined unclogging speed to break up the clogged ice. In this regard, if a clog or frozen icemaker is detected at step 340, controller 156 may operate BLDC motor 260 at a predetermined unclogging speed to generate large amounts of torque that may free up auger 230. In this regard, for example, the predetermined unclogging speed may be specified relative to a rated speed of the BLDC motor 260, e.g., from 0% to 100% of the full rated power and/or speed of the motor. In this regard, a predetermined unclogging speed may be between about 0% and 50% of the rated speed, between about 10% and 40% of the rated speed, between about 20% and 30% of the rated speed, or about 25% of the rated speed of BLDC motor 260. According to exemplary embodiments, the target speed for unclogging the icemaker may be between about 0 and 2 revolutions per minute, between about 0.5 and 1.5 revolutions per minute, or about 1 revolution per minute.

FIG. 5 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 300 is explained using icemaker 200 as an example, it should be appreciated that this method may be applied to the operation of any suitable ice making appliance or ice dispensing assembly.

Aspects of the present subject matter are generally directed to a nugget icemaker that includes a BLDC motor with a speed closed loop control system and associated methods of operation that facilitate improved icemaker operation. For example, the BLDC motor can rotate an auger at any suitable speed to adjust the type or quality of ice dispensed per user preference. In this regard, for example, faster auger rotation may tend to create flake ice that is fluffy and has low density. By contrast, slower rotation may tend to create solid ice nuggets that are compressed densely. Moreover, a user may select any suitable ice hardness or density therebetween and the BLDC motor can modify operation to dispense the desired ice. In this regard, by adjusting the RPM of the BLDC motor, the BLDC motor can provide the constant speed and sufficient torque, thereby generating different shapes or density of ice. Moreover, the sealed system operation may be adjusted to generate ice slower or quicker and the BLDC motor may also be used to detect ice clogs or a frozen ice jam and may operate at low speeds and high torques to quickly and easily clear the jam.

According to exemplary embodiments, the BLDC motor with speed closed loop control system allows for extremely precise speed control, providing constant speed at various torques (see, e.g., FIG. 6). For example, the speed closed loop speed control can drive the BLDC motor and detect the real speed by measuring a speed reference signal. In this regard, the speed reference signal may be determined by measuring the current of each phase of the BLDC motor to estimate the real speed and/or the rotor angle of the BLDC motor (for a field-oriented-control algorithm).

According to exemplary embodiments, when the real speed is lower than the target speed, the drive will increase the pulse-width modulated ("PWM") duty cycle to increase the BLDC motor voltage to increase the RPM of the motor, so that the actual speed is constant. By contrast, when the real speed is higher than the target speed, the drive will decrease the PWM duty to decrease the motor voltage to decrease the RPM of the motor, so that we can get the constant speed. The short action time of the RPM adjustment may prevent the ice maker from freezing.

Notably, aspects of the present subject matter can also detect and clear ice jams within the icemaker. For example, if the ice jams due to some failure from the icemaker, the PWM duty cycle may be increased in an attempt to reach a target speed. For example, if the PWM duty cycle reaches 100% percent and the load torque keeps increasing, a jam may be presumed. According, the controller may reduce the speed of the BLDS motor, which will result in a torque increase that can help break up any ice clogs.

In general, aspects of the present subject matter include implementation of speed-closed-control-loop where the drive may detect the real speed by measuring a speed-reference-single, e.g., by measuring the current of each phase of the motor to estimate the real speed or the rotor angle of the motor (for FOC algorithm). According to exemplary embodiments, when the real speed is lower than the target speed, the drive can increase the PWM duty to increase the motor voltage to increase the RPM of the motor, so that the actual speed is constant. By contrast, when the real speed is higher than the target speed, the drive can decrease the PWM duty to decrease the motor voltage to decrease the RPM of the motor, so that we can get the constant speed. The short action time of the RPM adjustment can prevent the ice maker from freezing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An icemaker comprising: a casing defining an interior volume; a water supply for selectively providing water into the interior volume; a sealed system comprising an evaporator in thermal communication with the casing for selectively freezing the water; an auger mounted within the interior volume, the auger being rotatable to scrape the ice from the casing; a brushless direct current (BLDC) motor mechanically coupled to the auger to selectively rotate the auger; and a controller in operative communication with the BLDC motor, the controller being configured to: obtain an ice production parameter from a user of the icemaker; determine a target speed of the auger based at least in part on the ice production parameter; and operate the BLDC motor to rotate the auger at the target speed and generate ice in accordance with the ice production parameter.

2. The icemaker of claim 1, wherein the ice production parameter comprises a hardness or density level of the ice.

3. The icemaker of claim 2, wherein determining the target speed comprises using a predetermined moderate speed to form hard ice and a predetermined fast speed to form flake ice.

4. The icemaker of claim 3, wherein the predetermined moderate speed is between about 25% and 75% of a rated speed of the BLDC motor.

5. The icemaker of claim 3, wherein the target speed for the hard ice is about 3.5 revolutions per minute.

6. The icemaker of claim 3, wherein the predetermined fast speed is between about 50% and 100% of a rated speed of the BLDC motor.

7. The icemaker of claim 3, wherein the target speed for the flake ice is about 4.6 revolutions per minute.

8. The icemaker of claim 1, wherein the ice production parameter specifies an ice formation rate of the ice.

9. The icemaker of claim 1, wherein the controller is further configured to:

determine that the icemaker is going to be in a frozen or locked up state; and operate the BLDC motor at a predetermined unclogging speed to break up the ice formed in the interior volume.

10. The icemaker of claim 9, wherein the predetermined unclogging speed is between about 5% and 25% of a rated speed of the BLDC motor.

11. The icemaker of claim 1, wherein obtaining the ice production parameter from the user of the icemaker comprises receiving an input from a user interface panel.

12. The icemaker of claim 1, wherein the icemaker is mounted within a refrigerator appliance.

13. The icemaker of claim 12, wherein the refrigerator appliance comprises a door that is rotatably hinged to a cabinet and defines an icebox compartment, the icemaker being positioned within the icebox compartment.

14. A method of operating an icemaker, the icemaker comprising an auger rotatably mounted within a casing to scrape ice from the casing and a brushless direct current (BLDC) motor mechanically coupled to the auger to selectively rotate the auger, the method comprising: obtaining an ice production parameter from a user of the icemaker; determining a target speed of the auger based at least in part on the ice production parameter; and operating the BLDC motor to rotate the auger at the target speed and generate ice in accordance with the ice production parameter.

15. The method of claim 14, wherein the ice production parameter comprises a hardness or density level of the ice.

16. The method of claim 15, wherein determining the target speed comprises using a predetermined moderate speed to form hard ice and a predetermined fast speed to form flake ice.

17. The method of claim 14, wherein the ice production parameter specifies an ice formation rate of the ice.

18. The method of claim 14, further comprising:

determining that the icemaker is in a frozen or locked up state; and operating the BLDC motor at a predetermined unclogging speed to break up the ice formed in the casing.

* * * * *